US009713571B2

(12) United States Patent
McLane et al.

(10) Patent No.: US 9,713,571 B2
(45) Date of Patent: Jul. 25, 2017

(54) SPA CABINET ATTACHMENT

(71) Applicants: Mark McLane, Lehi, UT (US); Eric Hales, Eagle Mountain, UT (US)

(72) Inventors: Mark McLane, Lehi, UT (US); Eric Hales, Eagle Mountain, UT (US)

( * ) Notice: Subject to any disclaimer, the term of this patent is extended or adjusted under 35 U.S.C. 154(b) by 226 days.

(21) Appl. No.: 14/606,232

(22) Filed: Jan. 27, 2015

(65) Prior Publication Data

US 2016/0213561 A1 Jul. 28, 2016

(51) Int. Cl.

| | |
|---|---|
| ***A61H 33/00*** | (2006.01) |
| ***E04H 4/00*** | (2006.01) |
| ***A47B 95/00*** | (2006.01) |
| ***A47B 96/00*** | (2006.01) |
| ***A47B 47/00*** | (2006.01) |
| ***A47B 81/00*** | (2006.01) |
| *A47K 3/16* | (2006.01) |

(52) U.S. Cl.

CPC ..... *A61H 33/6005* (2013.01); *A47B 47/0075* (2013.01); *A47B 81/00* (2013.01); *A47B 95/00* (2013.01); *A47B 96/00* (2013.01); *E04H 4/0031* (2013.01); *E04H 4/0043* (2013.01); *A47B 2220/03* (2013.01); *A47K 3/161* (2013.01); *A61H 2201/0107* (2013.01); *E04H 2004/0068* (2013.01)

(58) Field of Classification Search

CPC ..... A61H 33/60; A61H 33/6005
USPC ..... 4/584, 592
See application file for complete search history.

(56) References Cited

U.S. PATENT DOCUMENTS 5,466,058 A * 11/1995 Chan ..... A47B 47/0075 312/107
2005/0062377 A1* 3/2005 Hightower ..... A47B 96/00 312/265.5

* cited by examiner

*Primary Examiner* — Tuan N Nguyen
(74) *Attorney, Agent, or Firm* — Amy Fiene; James Sonntag

(57) ABSTRACT

A spa cabinet construction system where horizontal panels on the sides are mounted with a horizontal clip strip that mates with horizontal snaps attached to vertical members, and where corner profiles are mounted with a vertical clip strips that mate with vertical snaps.

14 Claims, 13 Drawing Sheets

SPA CABINET ATTACHMENT

BACKGROUND

There are a number of ways that the spa industry has designed paneling and cabinetry, however the use of visible screws or some form of fastener or latch has long since been considered necessary. Efforts to cover up some of these screws along with mismatched joints have taken the form of trim strips that run along the jointed seam.

SUMMARY

The present disclosure involves a new cabinet design that excludes any visible latching system. There are two distinct aspects of this design. One is referred to as the door and panel design or panel system and refers to the straight vertical sides of the cabinet. The other is the corner system which refers to structure at the corners where the vertical sides come together.

The panel system is a combination of four components; (1) horizontal clip strip, (2) side panel, (3) at least two vertical members, each with a horizontal snap, and (4) overlapping lip for receiving groove which can either be the shell of the spa or a separate extrusion below the shell of the spa.

The corner system comprises a combination of three components: (1) corner profile, (2) vertical clip strip mounted on the inside surface of the corner profile, and (3) vertical snap mounted to the cabinet structure. The vertical snap is mounted to the cabinet frame and provides a snap structure into which the vertical clip strip may be removably inserted and held in place. The vertical snap can be supported by vertical members on adjacent sides on or near either side of the corner.

With this design, the panel and corner systems can be snapped into place with minimal construction effort using simple tools or no tools at all and without the use of fasteners. This construction is structurally sound and compliant with UL requirements, while giving the cabinetry a look and feel that is unlike anything else in the spa industry. The look is streamlined without any major interruptions in flow and does not have the spotted fasteners that stand out in current assembly methods.

The panel and corner systems can both be applied together in the same cabinet, or each can be applied alone into separate cabinet constructions. For example, the panel system can be utilized alone on some existing spa constructions. Some current designs would benefit from the panel system, while not requiring use of the corner system. The new corner system may be optional, and may not be used to avoid additional tooling and investment (due, for example, to a possible different size of the corner profile, as a corner system may be too large to accommodate the clip construction).

These two designs can help reduce some of the problems with warping and stress while providing a sleek design that has not been created before in the industry. The side panels are locked in vertically but the horizontal clip strip allows the panel to expand or contract without restriction due to thermal expansion. The corner system is either spaced far enough away from the side panel to allow this expansion to take place or it overlaps the side panel and allows the expansion to occur behind the corner system flange. This is a significant improvement to a common problem in this industry.

Also contemplated is a system of attaching side panels to a spa cabinet comprising:

generally flat side panel with an outside surface providing an outside flat side surface for the cabinet, and an inside surface;

horizontal clip strip mounted horizontally within the inside surface of the side panel;

at least two vertical structural members, each with a horizontal snap, the horizontal snap configured to reversibly receive and hold in place the horizontal clip strip providing a lower attachment that allows movement along the horizontal clip strip; the horizontal clip strip having a constant cross-sectional profile along its length that allows the lower attachment at any point on the profile and provides the movement along the horizontal clip strip by allowing movement of the lower attachment along the profile, and receiving groove with an open bottom and positioned to receive an upper horizontal edge of the side panel and provide an upper attachment;

the side panel maintained in a vertical plane by the lower attachment and the upper attachment allowing vertical movement of the side panel in the vertical plane.

Also contemplated is a system for attaching corners to a spa cabinet comprising;

corner profile with an outside surface that provides a corner profile surface for the corner of the cabinet, and an inside surface;

vertical clip strip mounted vertically on the inside surface of the corner profile; and vertical snap, the vertical snap configured to reversibly receive and hold in place the vertical clip strip providing an attachment that allows movement along the vertical clip strip; the vertical clip strip having a constant cross-sectional profile along its length that allows the attachment at any point on the profile and provides the movement along the vertical strip by allowing movement of the attachment along the profile.

Also contemplated is a system for attaching side pieces of a spa cabinet comprising;

cabinet profile piece with an outside surface providing an profile surface for outside of the cabinet and an inside surface;

clip strip mounted on the inside surface of the profile piece; and snap configured to reversibly receive and hold in place the clip strip allows movement along the clip strip, the horizontal snap configured to reversibly receive and hold in place the horizontal clip strip providing a lower attachment that allows movement along the horizontal clip strip;

the clip strip having a constant cross-sectional profile along its length that allows the attachment at any point on the profile and provides the movement along the clip strip by allowing movement of the lower along the profile.

DETAILED DESCRIPTION

Panel System—Door and Side Panels

Figure 1:
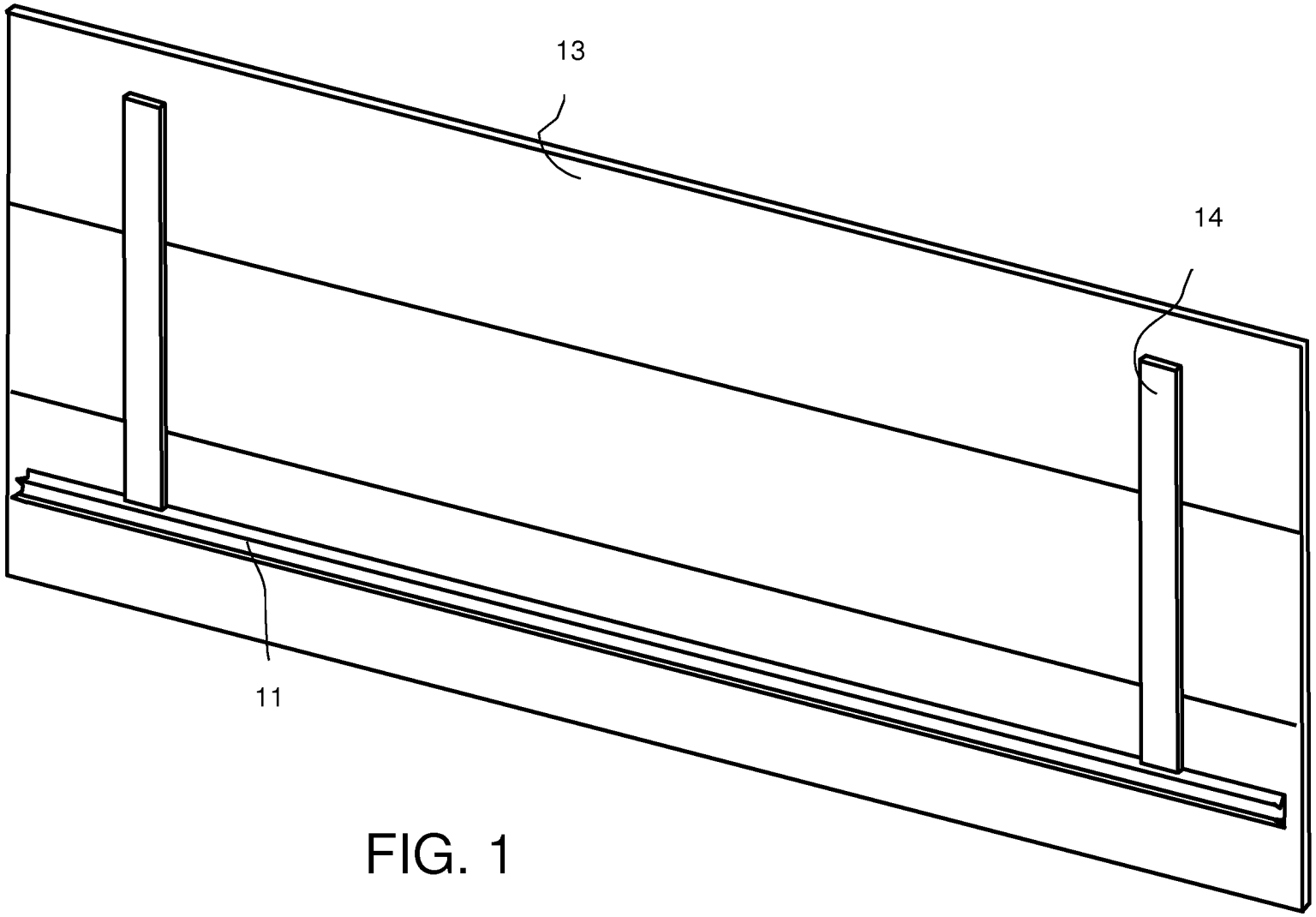
FIG. 1 is a perspective view of a side panel with a horizontal clip strip.
Figure 2:
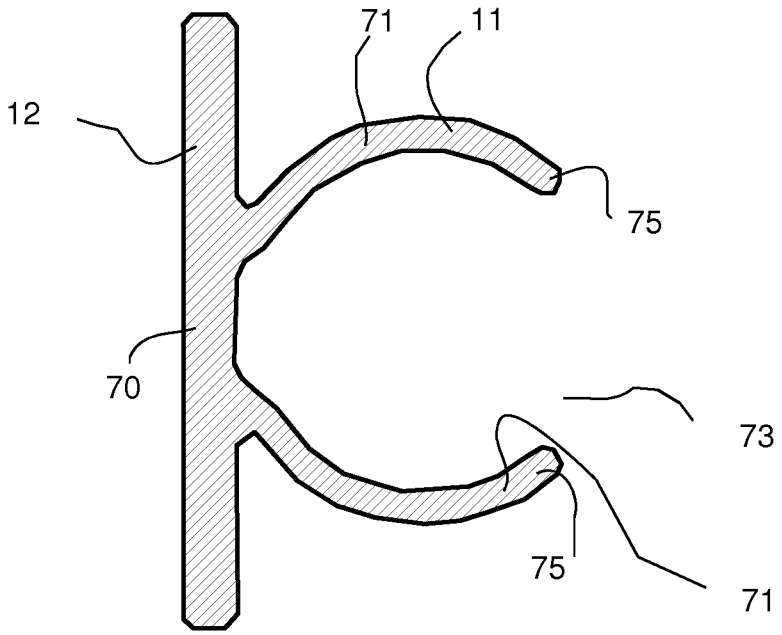
FIG. 2 is a cross sectional view of a horizontal clip strip.
Figure 3:
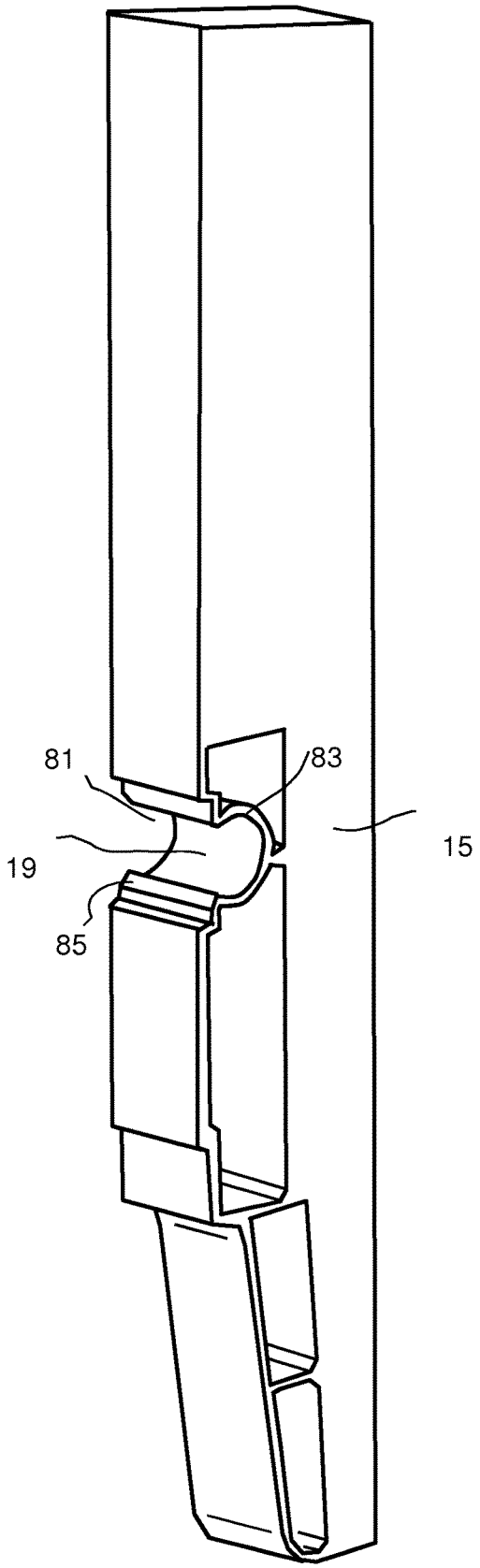
FIG. 3 is a perspective view of a vertical member.

Referring to FIGS. 1, 2, and 3, a panel system is illustrated. A side panel 13 has a horizontal clip strip 11 mounted onto its side. The horizontal clip strip 11 extends horizontally along most of the length of the side panel to provide attachment structure at any point along the horizontal clip strip 11 where the side panel 13 can be mounted, and it also stiffens the side panel 13 by extending to or near to each end of the side panel 13.

The cross-sectional profile of a horizontal clip strip 11 is constant. An exemplary horizontal clip strip cross-section is shown in FIG. 2, is generally a C-shape with a backing structure 12 for mounting to the side panel at the back of the C. Other structures and elements may also be used. The C-shape and backing structure may be of one material or of different structures. Also, they may be connected or attached, or they may be made as one piece. The horizontal clip strip may be an extruded thermoplastic shape of the constant cross-section.

Various fasteners or mounting methods can be used to mount this extruded horizontal clip strip on the side panel, such as one of or a combination of fixing it in place with an adhesive, polymeric welding methods, complementary or matching locking structures, and mechanical fasteners such as screws, brads or nails. An integrated clip/side panel structure can also be extruded or molded. A combination of gluing or adhering in place and further secured in place with brads has been found suitable.

Referring again also to FIG. 1, a practical material of the horizontal clip strip 11 and the side panel 13 is comprised of the same or different thermoplastic materials, but other materials may be suitable that can function in the panel system, such as wood, metal, composites, laminates. Extrusion of thermoplastic is a suitable method of fabrication the panel from thermoplastic. Suitable methods include, but are not limited to extrusion, molding, stamping, milling, or a combination thereof. The side panel may be of one piece or of several boards of material assembled into a panel by, for example, gluing boards together or connecting boards with a tie member 14.

The vertical members are vertical structures, usually of the spa cabinet frame, that are configured to receive the horizontal clip strip. These can be members that are also structural supports for some of the spa components other than the side panels. An example of structural vertical members that can be modified to receive the horizontal clip strip are disclosed in U.S. Pat. No. 8,881,321 to Ludlow et al., issued Nov. 11, 2014, which is hereby incorporated by reference. This patent discloses support structure for a spa where vertical structural members extend from a spa base and are structured with grooves for supporting horizontal splines to mount side panels. In the present disclosure, these splines with mounted panels can be replaced by the current panel system.

Referring to FIG. 3, a vertical structural member 15 which is configured with a horizontal snap 19 is shown. The vertical structural member 15 is a structure that generally spans the vertical distance, top to bottom, of the sides of a spa or spa endpoints. The top point may be just below, near, or at the underside of a spa cover. Alternatively, the vertical structural member 15 may extend from above the spa cover or the top of the spa cover. The vertical structural member 15 may extend to a location at or near the base of the spa base, the ground or a point below the bottom end of the spa. The vertical structural member 15 may be used to support one or more of the spa cover, spa chamber access, spa shell, etc., however it may be non-supportive.

The horizontal snap 19 comprises a hollowed rounded region that forms a partial cylinder spatially. As shown, the horizontal snap 19 may be located midway along the vertical structural member 15, however, other locations along the vertical structural member 15 are envisioned.

Figure 4:
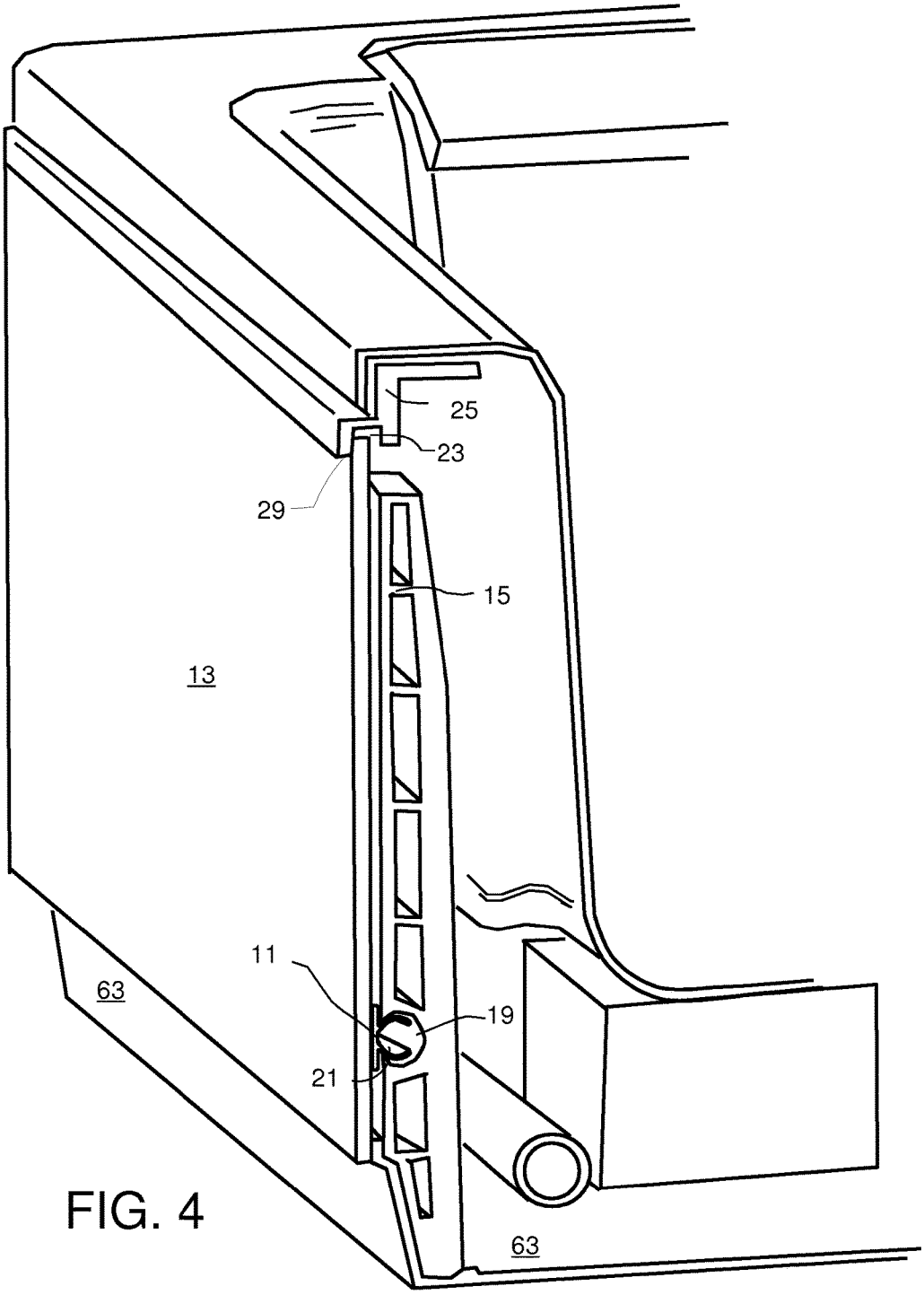
FIG. 4 is a perspective view with a cut-away showing an installed vertical member and side panel showing the lower attachment of the horizontal clip strip and horizontal snap, and the upper attachment of the upper edge of the panel in a receiving groove.

Referring to FIG. 4, a cross-section of a spa wall, a vertical member 15 mounted in a spa base 63 and with an attached side panel 13 is shown. The horizontal snap 19 is structured to attach to a region or portion along the horizontal clip strip 11. In this manner, side panel 13, which is attached to the vertical structural member 15, may be attached at an attachment point 21. As shown in FIG. 4, the horizontal clip strip 11 has been pushed into the horizontal snap 19 to interlock them together.

Referring also to FIG. 2, and FIG. 3, the horizontal clip strip 11 has a "C-clip" cross-sectional area with a base 70 and two curved arms 71 that extend initially apart from each other and then converging toward each other to an opening 73 between their ends 75. The arms are elastically resilient so that the ends 75 of the arms 71 can be forced to narrow the width of the clip to allow insertion into the opening 81 of the horizontal snap 19, and after insertion elastically return to hold into, or engage, the undercut 83 of the horizontal snap 19. Outer surface of arms 71 rest against exterior surface of undercut 83 of horizontal snap 19. The horizontal snap 19 is structured to receive the ends 75 of the horizontal clip strip 11 and upon application of force at the base of the horizontal clip strip 11 has opposing ramp or cam surfaces 85 that compress the ends and direct same into and through an opening which may be a partial cylinder in volume, but which may be a different space of volume. After the insertion of the horizontal clip strip 11, the elastic force of the clip and structures that interlock the horizontal clip strip 11 and the horizontal snap 19 lock the horizontal clip strip 11 and horizontal snap 19 together.

Note that the horizontal clip strip 11 may be removed from the horizontal snap 19 by physically or otherwise pulling the horizontal clip strip 11 away from the horizontal snap 19. Application of force may be exerted on the side panel 13 attached to the horizontal clip strip 11 to achieve disengagement. Note that removal may include squeezing the arms 75 of the horizontal clip strip 11 together to reduce the amount of force needed to remove the cam engagement between the horizontal clip strip 11 and the horizontal snap 19.

A main consideration in the construction of the horizontal clip strip 11 and the horizontal snap 19 is that they resist vertical forces, and forces that would part their locked connection, while still allowing movement or travel of the horizontal clip strip 11 through the horizontal snap 19 along the horizontal axes of the horizontal clip strip 11 and horizontal snap 19. As described below, this has the advantage of a simple reversible installation and compensation for thermal expansion. Basically, an attachment system where the two attaching structures have constant cross-section around a horizontal axis, and where the horizontal clip strip 11 has structure along its length to fix to the side panel is required.

As in the illustrated example, a suitable attachment is where one structure has elastically resilient member/members that can be compressed or deformed into a rigid structure, and locked as the resilient members at least partially return to their original position. In addition to the horizontal clip strip 11 with C-clip shape and resilient members/rigid cavity configuration that is illustrated, other locking designs may be suitable, such as a rigid arrow-head or bead locking with resilient cavity combination. In the illustrated example, the C-clip shape may be also modified to a resilient arrow-head configuration. In addition, the resilient C-cross-section can be mounted on or incorporated into the vertical member and the horizontal clip strip 11 having a rigid cavity cross-section.

For each side panel in a conventional square or rectangular cabinet shape, at least two vertical members 15 with incorporated horizontal snaps 19 are required to secure the side panel to at least two lower attachment points 21. Contemplated, for example, are three or four vertical members for a side panel; four may be particularly suitable on the side with widely spaced vertical members for access to the pump and accessory chamber.

While side panels will frequently extend the length of a spa cabinet side, there may be constructions where short segments may be used that require only one lower attachment to a horizontal clip strip 11. For example, a separate, very short segment can be mounted onto a vertical member that has been mounted on the tangent line of the corner curve. Such a side panel may be straight, or profiled similar to a corner profile described below, and be used in a corner or on part of a straight side as a structural or decorative element.

It is contemplated that the present panel system be applied to other spa constructions, other than that illustrated. This requires suitably positioned members that can be formed or can mount the horizontal snap with the suitable locking snap structure. Although the members are shown as vertical members, they may instead be horizontal members at the suitable height.

Generally, minimal alteration to an existing structural member of the cabinet frame is required to provide a snap. The vertical snaps are thereby easily incorporated into an existing design, and since the horizontal clip strip is fixed to the side panel, no added horizontal support structures are required on the spa frame.

Referring to FIG. 4, there is a receiving groove 23 within which the upper edge of the side panel 13 is inserted during assembly to provide an upper attachment 29. The receiving groove 23 may be provided, for example, by overhanging the lip or edge of the spa shell over the top of the cabinet or by a separate structure 25 above the side panel 13. The receiving groove 23 is configured with a downwardly facing opening that is sized to receive a top edge of a side panel 13. Once in the receiving groove, the top edge is restrained from movement where the panel would fall out and away from the side. However, it is not tightly held which allows the side panel to float vertically and horizontally along the axis of the receiving groove 23.

With the side panel 13 mounted, the lower attachment 21 bears most of the weight of the side panel 13 and allows horizontal travel of the horizontal clip strip 11 through the horizontal snap 19, while the upper attachment 29 prevents a horizontal movement that would let the panel fall out. However, vertical movement provided in the receiving groove and horizontal movement provided along axes of the groove and clip allow the panel to contract and expand without stressing the panel to cause buckling or warping.

In contrast to conventional construction where panels are fixed at several points, the integrity and appearance of the cabinet is ensured under wide temperature fluctuations by allowing vertical and horizontal movement in the plane of the side panel. Such a structural configuration relieves stresses that otherwise would warp, twist or tension the side panel. Not only is this beneficial for structural integrity, but it also provides and maintains the aesthetics and outward appearance of a spa.

The horizontal clip strip 11 also acts as a support bracket running the almost the full length of the side panel giving added strength to prevent warping or twisting. Such a bracket would normally interfere with the vertical members.

The receiving groove 23 can be provided by any suitable structure, such as a separate structure 25 extending along the outer top edge of the spa cabinet as illustrated in FIG. 4.

Figure 5A:
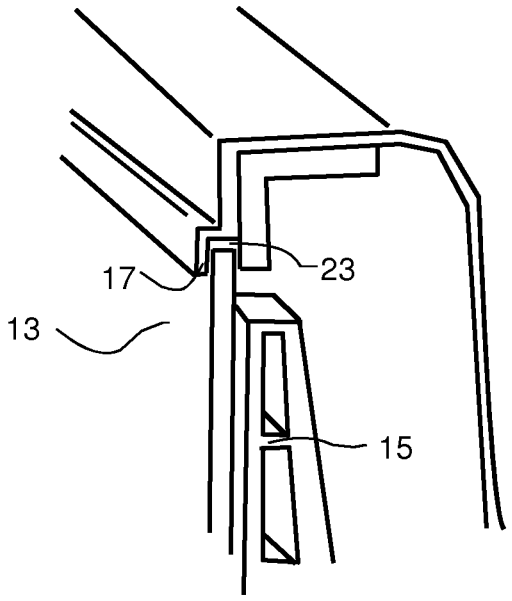
FIGS. 5*a* and 5*b* are perspective views of alternate receiving groove constructions.
Figure 5B:
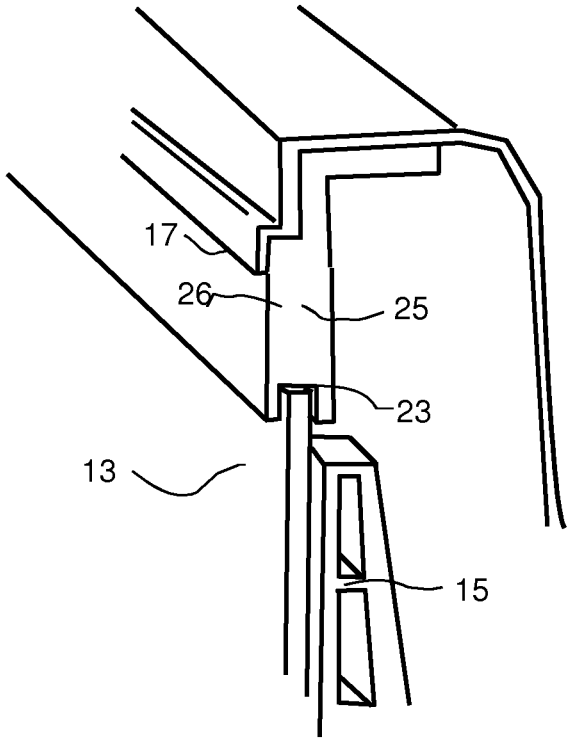

Referring to FIG. 5*a* and FIG. 5*b*, details of alternate receiving groove 23 configurations are shown. In FIG. 5*a*, an overhanging edge or lip 17 of the spa shell can be used to form the receiving groove 23. As shown in FIG. 5*b*, the receiving groove 23 may also be in separating structure 25 spaced below the top of the cabinet with a horizontal band 26 (e.g., for decoration or lighting) between the edge of the spa shell 17 and the receiving groove 23.

The panel system is usually to provide the exterior flat sides of the spa cabinet. The panel system can be used for any selected side or sides of the cabinet or for all four sides of the cabinet. The side panel may be a panel that is flexible such that it wraps around part of the spa cavity or the entire spa cavity. The side panel with attached horizontal clip strip or strips to attach to corresponding vertical members may include folds, bends, or joints that promote wrapping around the spa cavity.

In conventional prior-art spa construction, one side of a spa may include a separate removable panel for access to a pump and accessory chamber. With the current design, the entire side panel and horizontal clip strip is removable and reinstallable without expending any attachment hardware or making irreversible changes. Since the whole panel can be removed for access, an additional access opening in the side panel for pump and chamber access is not required.

To assemble a spa cabinet with the panel system, the side wall is positioned over the vertical members with the upper edge of the side panel slipped or inserted into the receiving groove. The side panel position is adjusted to align the horizontal clip strip with the horizontal snaps, and the horizontal clip strip is pushed into each of the horizontal snaps to lock them together. After the horizontal clip strip is secured in all of the horizontal snaps, side panel may be adjusted horizontally to center it relative to the spa. The side panel is thereby secured at its upper edge by the receiving groove, and by the horizontal clip strip on the lower half of the panel. No other assembly is required. After the panel system is assembled, corner structures, such as of the corner system, can be assembled on the spa.

The panel system has several advantages:

(1) Reversible assembly without fasteners to create a rigid structure, (2) Structure to prevent warping that can easily occur in the prior-art construction where several screws are used, especially warping of the panel across a wide unsupported space, such as across the entry to the pump chamber where vertical members are fewer in number or are widely spaced.

(3) Securement of the side panel more tightly and prevent relative movement to vertical members across the full length of the panel along the horizontal clip strip, as opposed to conventional systems where screws on the outer edge do little or nothing for holding the middle of the panel tight.

(4) Compensation for thermal expansion and contraction of the side panel, which sets in when the spa is exposed to hot or cold outdoor conditions. This is in contrast to a typical conventional panel with a screwed locked-in design that either warps or causes tension in the assembly. With the present panel system using a horizontal clip and snap attachment a side panel is allowed to freely transit horizontally along the axis of the horizontal clip strip without obstruction. In addition, the top edge of the side panel can move in the receiving groove in response to thermal changes. Accordingly, this mounting system does not create the situation that would cause warping or tension.

A side panel together with its horizontal clip strip can simply be removed by first removing an adjacent corner, if necessary to free the edge. One then grabs the side of the panel near where the horizontal clip strip is attached, and physically pulls the horizontal clip out of the horizontal snaps in the vertical members consecutively down the length of the panel until it is completely released. Then the side panel slides downward out of the receiving groove and is removed.

Corner System

The corner system is constructed similar to the panel system. It comprises (1) corner profile, (2) a vertical clip constructed essentially the same as the horizontal clip, but disposed vertically, and (3) vertical snap similar in construction to the horizontal snap for receiving the vertical clip. The vertical clip has the same cross-section as the horizontal clip strip, and the vertical snap has the same cross-section as the horizontal snap. In an alternate configuration, the cross-sections can be of a different size or configuration, but must function the same as the horizontal clip and snap, but be placed on a vertical axis. Alternate cross-section as discussed above for the horizontal clip and snap, may be suitable. The primary difference is that the moving or traveling axis of the attachment assembly in corner system is in a vertical direction.

In the illustrated example, the corner profile defines a 90 degree corner for a square or rectangular spa cabinet. It is contemplated that the corner profile may be of other angles for fabrication of cabinets of other shapes, such as regular or irregular polygons having 3 or more sides, or even star-shaped. Note that the corner profile may be rounded to form rounded sides and all kinds of shapes, including circular and oblong shapes.

Figure 6:
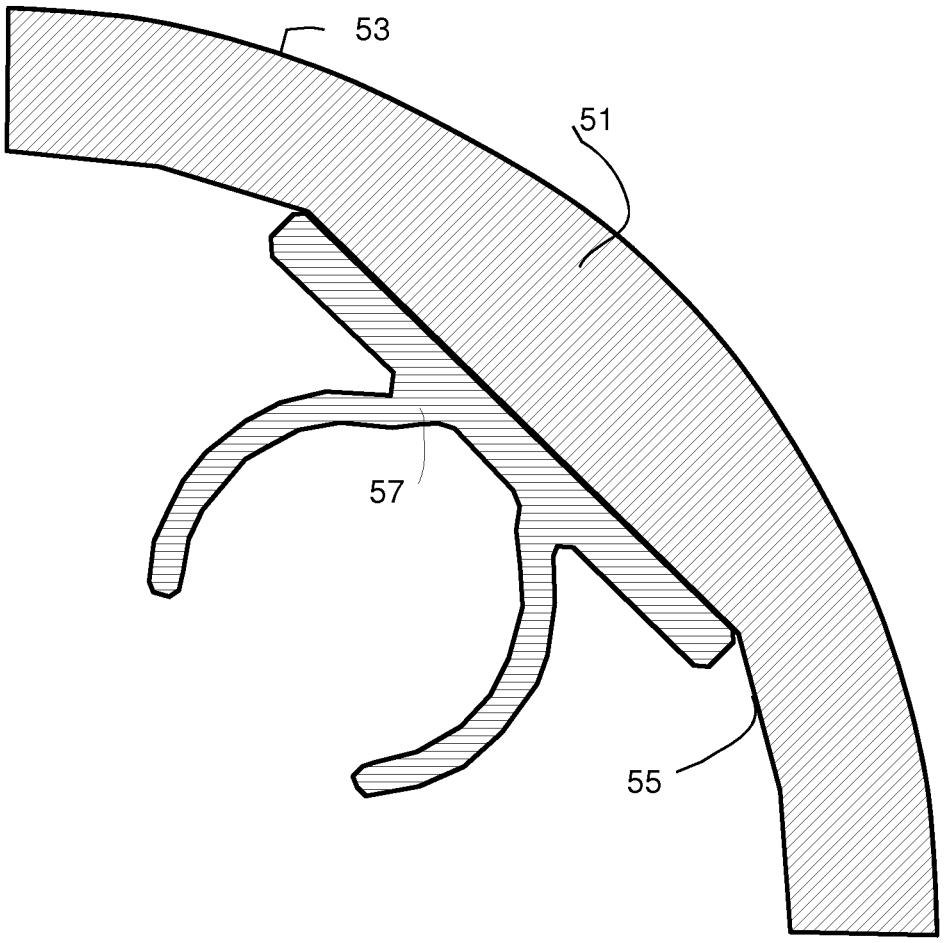
FIG. 6 shows a cross-sectional view of a corner piece with an attached vertical clip strip.
Figure 7:
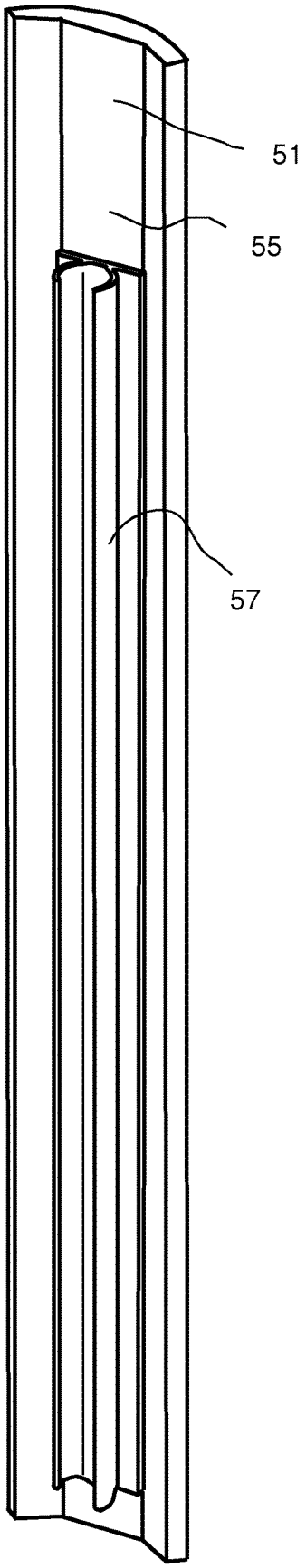
FIG. 7 is a perspective view showing the inside side of a corner piece with an attached vertical clip.

The angle may be "straight" or 180 degrees. Such a "corner" piece may be associated with some structural component or a decorative element along a straight side of the spa Referring to FIG. 6, a cross sectional view of corner profile 51 and vertical clip strip 57 is shown. The corner profile 51 has a curved cross-section with an outside surface 53 defining a curved exterior surface of the cabinet, and an inside surface 55. Referring also to FIG. 7, a vertical clip strip 57 is mounted onto the inside surface 55, and extends the whole or nearly the length of the corner profile 51.

Note that the vertical clip strip 57, in contrast to the horizontal clip strip 11, extends in a vertical direction. Although directions discussed refer to vertical and horizontal directions, directions may be angular and they may vary at distances.

The vertical clip strip 57 may be similar in size and shape to horizontal clip strip 11, however sizes and shapes may vary. The C-shape formed by the vertical clip strip 57 is at a 90 degree angle to the C-shape formed by the horizontal clip strip 11. The angles formed, however, may be less than or more than 90 degrees.

Figure 8:
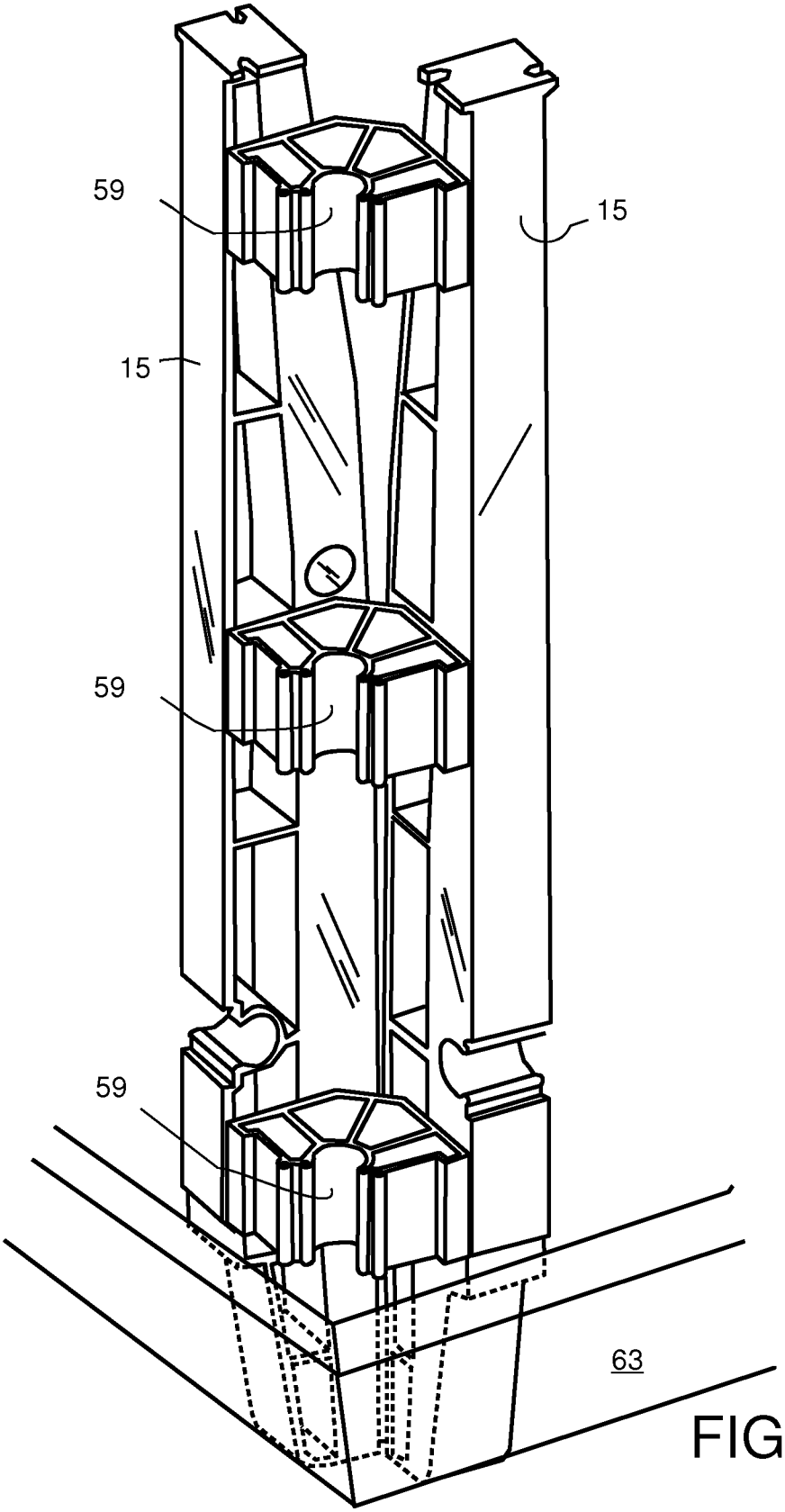
FIG. 8 is a perspective view of an assembly of three vertical snaps supported by two vertical members.
Figure 9:
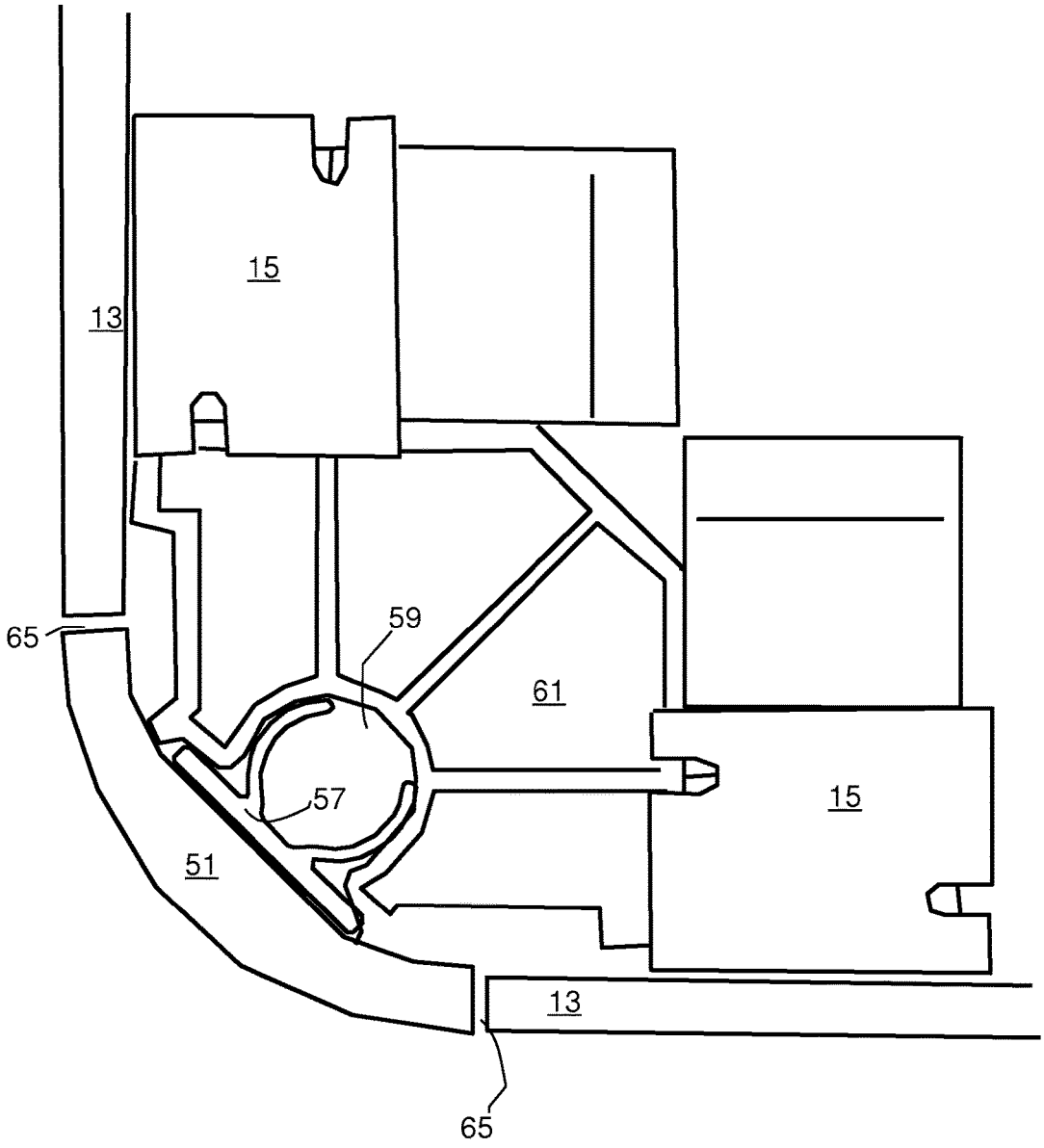
FIG. 9 is a top view of the assembly of FIG. 10 attached to a corner piece/vertical snap assembly.

Referring also to FIG. 8 and FIG. 9, a snap system with two or more vertical snaps 59 are located vertically along a vertical member. The vertical snaps 59 are designed to push together and lock to the vertical clip 57 strip in the same manner as the above horizontal clip strip and the horizontal snap. The corner profile 51 when so mounted can transport vertically through the vertical snaps 59, thus helping to prevent stresses that might tension or warp the corner profile 51.

Various fastening systems to mount the vertical clip strip to the corner profile can be the same as for the horizontal clip strip attachment to the side panel. A suitable method is to glue in place and further securing the vertical clip strip using brads.

In the illustrated exemplary construction, the corner system comprises three injection molded parts 61 that are between two vertical members 15 on either side of a corner. Each injection molded part 61 has a vertical snap 59 and supports the corner profile 51 by locking to the vertical clip strip 57. The combined two vertical members 15 both together supporting the injection molded parts 51 are installed in a spa base 63 in a similar way as other vertical members, but near the corner as illustrated in FIGS. 8 and 9.

The corner assembly of the corner profile 51 and vertical clip strip 57 is slipped up under or butted up against the structure at the top of the cabinet side, which may be, for example, an extension of receiving groove structure or an overhanging lip of the spa shell. It is not required to restrain the top of the corner piece from falling out, so no holding lip or groove is required for this purpose. The vertical clip strip is then forced into the three vertical snaps. The vertical clip strip can also acts as a stop on the base to keep the corner from slipping downward. While the corner profile 51 overlaps the base 63 of the spa, the vertical clip strip 57 protrudes into the spa such that it hits the upper lip of the base 63, preventing the corner from slipping downward.

The corner assembly may be load-bearing or non-load-bearing. For example, the corner assembly may be assembled with a top portion underneath the shell of the spa top or cover so as to provide support to the spa top or cover. Other support may be provided.

Removing the corner is done by slipping a small lever, like a flat-head screwdriver, underneath the corner profile and prying the vertical clip strip out of the lowest vertical snap. Once this is done the corner profile with vertical clip strip can be physically pulled off of the spa with a little effort. Alternatively, however, no tools may be needed to remove the corner profile and remove the vertical clip strip. Physical force may simply be used.

Figure 10:
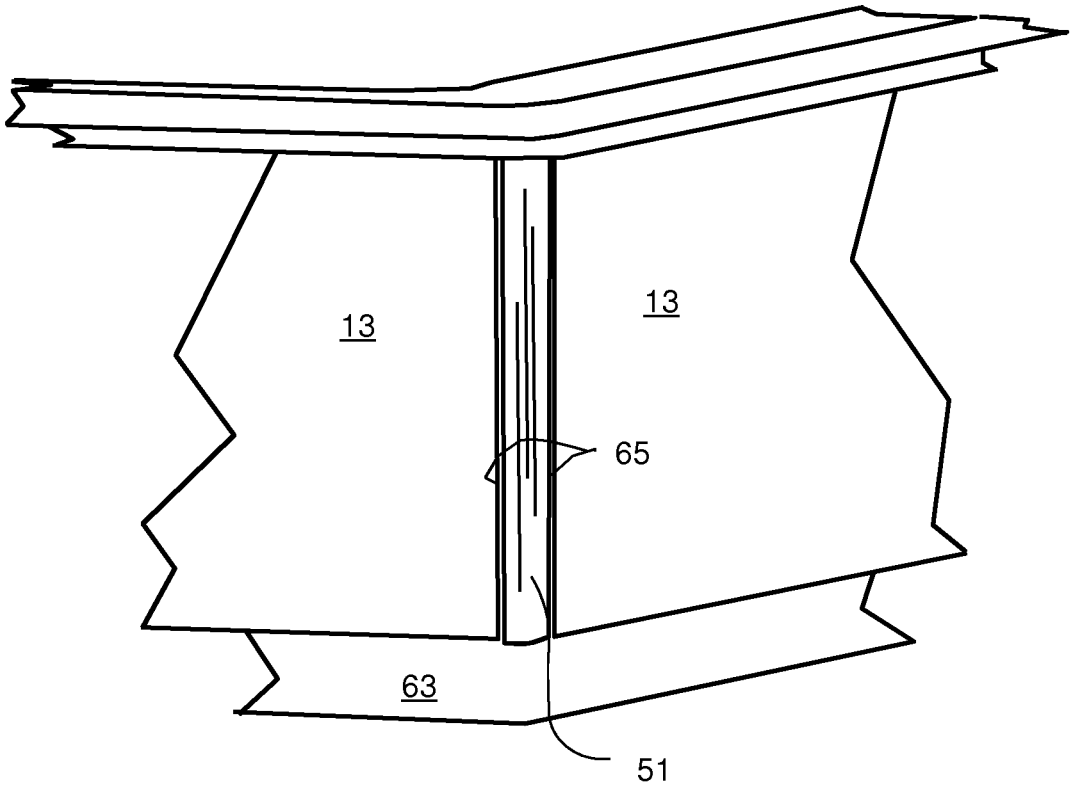
FIG. 10 is a perspective view of an assembled cabinet with butt joints between the corner pieces and side panels.

Referring to FIG. 10, the assembled cabinet shows spa base 63, the side panels 13, and the corner profiles 51, with edges of the side panels adjacent in a butt joint to the edges of the corner profiles 51 in a butt joint 65. (See also FIG. 9) With this construction the edges of the side panels are adjacent to the edges of the corner profile, spaced adjacent to each other such that there is a small gap at the joints.

Figure 11:
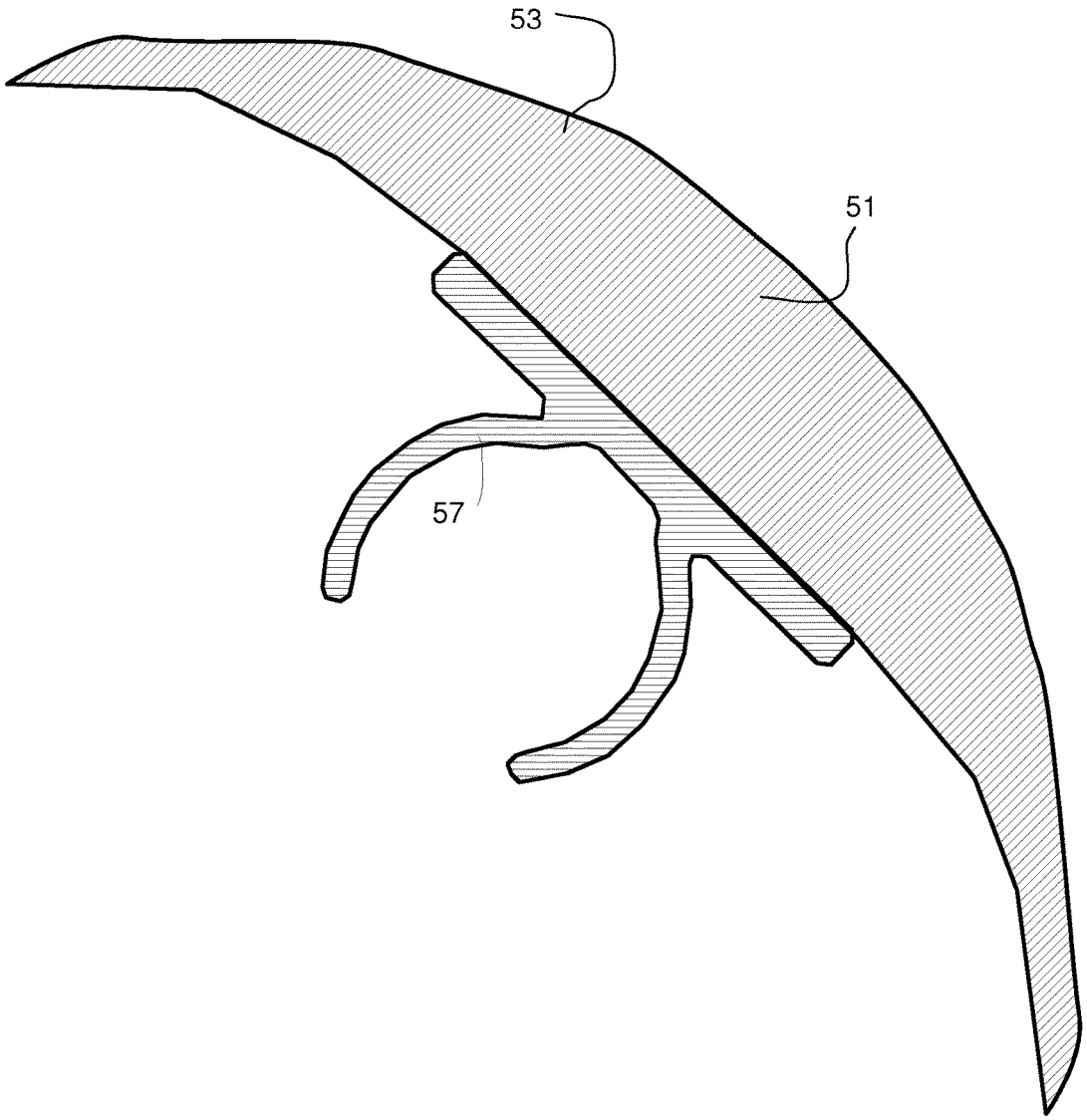
FIG. 11 shows a cross-section of an alternate corner piece with an attached vertical clip strip.
Figure 12:
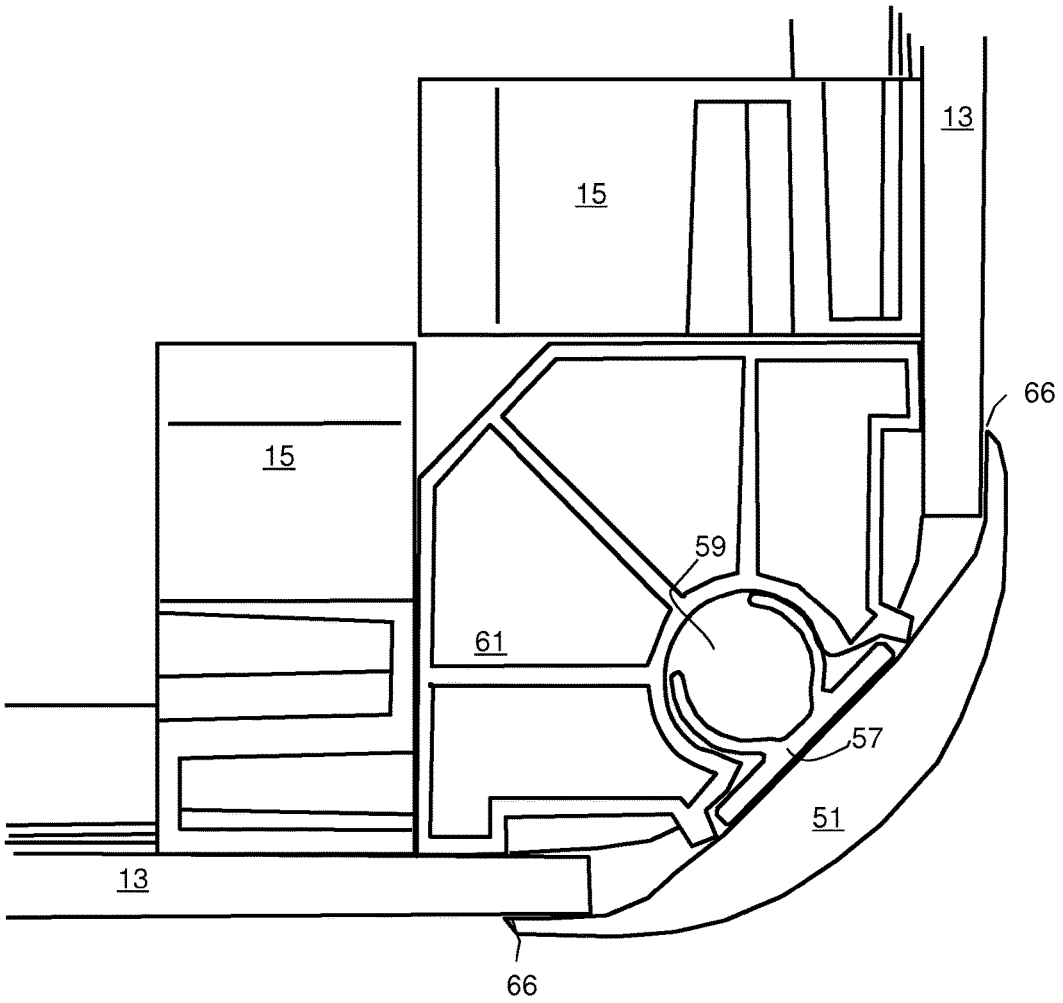
FIG. 12 is a top view of the assembly of FIG. 7 with attached corner piece/vertical snap assembly as in FIG. 10.
Figure 13:
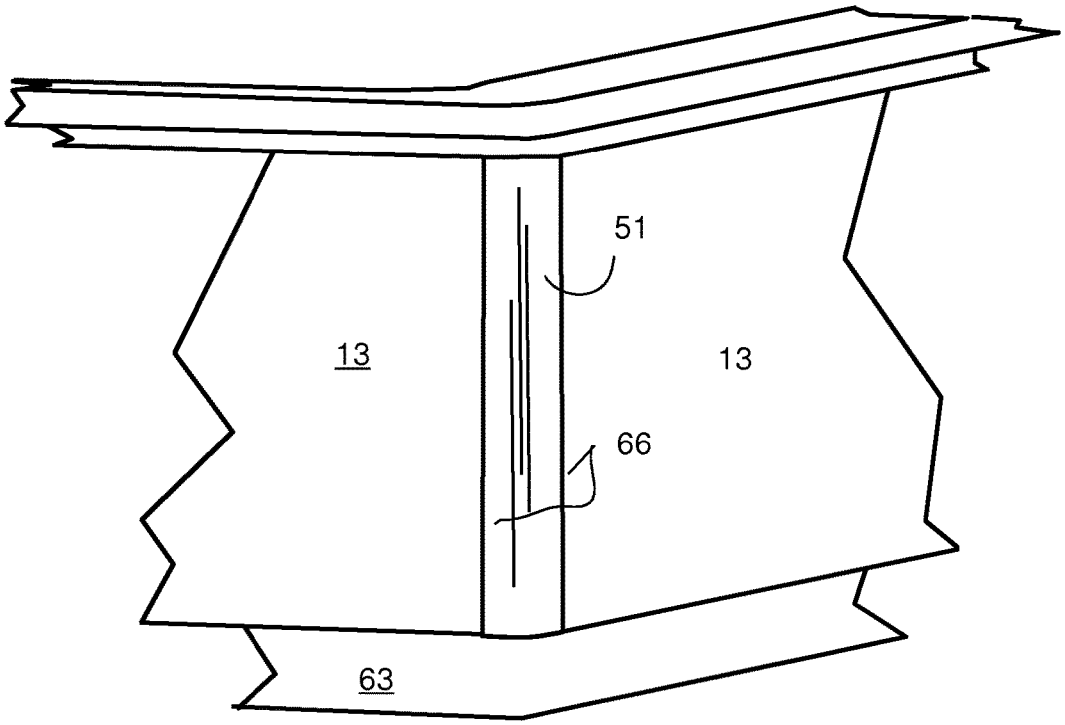
FIG. 13 is a perspective view of an assembled cabinet with overlapping corner pieces as in FIG. 11.

In an alternate construction, shown in FIGS. 11, 12 and 13, the corner profile 51 is configured so that its edges are tapered and extend over a side panel 13 forming an overlapping joint 66 with the side panels. This construction avoids a visible gap between the side panels 13 and the corner profiles 51. It also allows for less precision in overall assembly. In addition, the corner profiles 51 must be removed before removal of a side panel 13. The technology all stays the same; this is just a second approach to the corner profile.

In either construction, the visual presentation of the cabinet is clean with—smooth joint free surfaces and free from any marks or indication of screws or other fasteners. In the case of the latter illustrated in FIG. 13, no seams at the corners are apparent. This design may be advantageous in improving the aesthetic and overall streamline effect on the spa. Furthermore, it may hide the expansion from the spa panels.

While this invention has been described with reference to certain specific embodiments and examples, it will be recognized by those skilled in the art that many variations are possible without departing from the scope and spirit of this invention, and that the invention, as described by the claims, is intended to cover all changes and modifications of the invention which do not depart from the spirit of the invention.

What is claimed is:

1. A construction system for attaching side panels to a spa cabinet comprising:

a generally flat side panel with an outside surface providing an outside flat side surface for the cabinet, and an inside surface;

a horizontal clip strip mounted horizontally within the inside surface of the side panel;

at least two vertical structural members, each with a horizontal snap, the horizontal snap configured to reversibly receive and hold in place the horizontal clip strip providing a lower attachment that allows movement along the horizontal clip strip; the horizontal clip strip having a constant cross-sectional profile along its length that allows the lower attachment at any point on the profile and provides the movement along the horizontal clip strip by allowing movement of the lower attachment along the profile, and a receiving groove with an open bottom and positioned to receive an upper horizontal edge of the side panel and provide an upper attachment;

the side panel maintained in a vertical plane by the lower attachment and the upper attachment allowing vertical movement of the side panel in the vertical plane.

2. A construction system as in claim 1 additionally comprising a corner profile with an outside surface providing a corner profile surface for the corner of the cabinet and an inside surface;

a vertical clip strip mounted vertically on an inside surface of the corner profile; and a vertical snap, the vertical snap configured to reversibly receive and hold in place the vertical clip strip providing an attachment that allows movement along the vertical clip strip; the vertical clip strip having a constant cross-sectional profile along its vertical length that allows the attachment at any point on the profile and provides the movement along the vertical strip by allowing movement of the attachment along the profile.

3. The construction as in claim 2 wherein both the corner profile and the side panel have vertical side edges that that are spaced adjacent to each other.

4. The construction system as in claim 2 wherein the corner profile has a vertical side edge that overlies the surface of the side panel.

5. The construction system as in claim 4 wherein the vertical side edge of the corner profile is tapered.

6. The construction system as in claim 2 wherein the vertical clip strip and the horizontal clip strip have the same cross-sectional profile.

7. The construction system as in claim 1 wherein the cross-sectional profile of the horizontal clip strip is generally C-shaped with structure to mount to the side panels, and with and two resilient arms that extend initially apart from each other and then converging toward each other to an opening between their ends, and the cross-section of the vertical snap is a rigid cavity with an opening to receive the ends of the horizontal clip strip and lock the resilient clips in the cavity.

8. A construction system of attaching corners to a spa cabinet comprising:

a corner profile with an outside surface that provides a corner profile surface for the corner of the cabinet, and an inside surface;

a vertical clip strip mounted vertically on the inside surface of the corner profile; and a vertical snap mounted to framing of the cabinet, the vertical snap configured to reversibly receive and hold in place the vertical clip strip providing an attachment that allows movement along the vertical clip strip; the vertical clip strip having a constant cross-sectional profile along its length that allows the attachment at any point on the profile and provides the movement along the vertical strip by allowing movement of the attachment along the profile.

9. The construction system as in claim 8 wherein the cross-sectional profile of the vertical clip strip is generally C-shaped with structure to mount to the corner profile, and with and two resilient arms that extend initially apart from each other and then converging toward each other to an opening between their ends, and the cross-section of the vertical snap is a rigid cavity with an opening to receive the ends of the vertical clip strip and lock the resilient clips in the cavity.

10. A construction system of attaching side pieces of a spa cabinet comprising:

a cabinet profile piece with an outside surface providing a profile surface for outside of the cabinet and an inside surface;

a clip strip mounted on the inside surface of the profile piece; and a snap mounted to the cabinet and configured to reversibly receive and hold in place the clip strip, the clip strip having a constant cross-sectional profile along its length that allows the attachment at any point on the profile and that allows movement of the snap along the profile.

11. The construction system as in claim 10 wherein the spa cabinet has a rectangular shape, and the cabinet profile piece is a flat panel, or a corner profile.

12. The construction system as in claim 10 wherein the spa cabinet is a polygonal shape, and the outer surface of the cabinet profile piece has a straight surface or an angled surface.

13. The construction system as in claim 10 wherein the clip strip is mounted vertically, or horizontally.

14. The construction system as in claim 10 wherein the clip strip is mounted at a non-vertical or non-horizontal angle.

* * * * *